US009704471B1

(12) United States Patent
Ku

(10) Patent No.: US 9,704,471 B1
(45) Date of Patent: Jul. 11, 2017

(54) ADAPTIVE MODELING OF SECONDARY PATH IN AN ACTIVE NOISE CONTROL SYSTEM

(71) Applicant: Bose Corporation, Framingham, MA (US)

(72) Inventor: Emery M. Ku, Somerville, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/085,204

(22) Filed: Mar. 30, 2016

(51) Int. Cl.
*G10K 11/178* (2006.01)

(52) U.S. Cl.
CPC .... *G10K 11/178* (2013.01); *G10K 2210/1081* (2013.01); *G10K 2210/3018* (2013.01); *G10K 2210/3028* (2013.01)

(58) Field of Classification Search
CPC ..... G10K 11/178; G10K 2210/1081; G10K 2210/3018; G10K 2210/3028
See application file for complete search history.

(56) References Cited

U.S. PATENT DOCUMENTS 6,396,872 B1 5/2002 Sugiyama
7,343,016 B2 * 3/2008 Kim ..... G10K 11/178 381/71.1
9,324,311 B1 * 4/2016 Abdollahzadeh Milani ..... G10K 11/1784
2006/0069556 A1 * 3/2006 Nadjar ..... G10K 11/178 704/229
2010/0284546 A1 * 11/2010 DeBrunner ..... G10K 11/178 381/71.2
2016/0163304 A1 * 6/2016 Lee ..... G10K 11/178 381/71.4

OTHER PUBLICATIONS

Narahari; "Noise Cancellation in Headphones"; M. Tech. credit seminar report, Electronic Systems Group; Nov. 2003.
Akhtar, et al.; "Modified-Filtered-x LMS Algorighm Based Active Noice Control Systems with Improved Online Secondary-Path Modeling"; IEEE International Midwest Symposium on Circuits and Systems; 2004.

(Continued)

*Primary Examiner* — Brenda Bernardi
(74) *Attorney, Agent, or Firm* — Fish & Richardson P.C.

(57) ABSTRACT

The technology described herein can be embodied in a computer implemented method that includes detecting, by one or more processing devices, onset of an unstable condition in an active noise control system. The method also includes obtaining, responsive to detecting the onset of the unstable condition, updated filter coefficients for a system-identification filter configured to represent a transfer function of a secondary path of the active noise control system. The updated filter coefficients are generated using a set of multiple subband adaptive filters, wherein filter coefficients of each subband adaptive filter in the set are configured to adapt to changes in a corresponding portion of a frequency range associated with potential unstable conditions in the active noise control system. The method also includes programming the system identification filter with the updated coefficients to affect operation of the active noise control system.

20 Claims, 6 Drawing Sheets

(56) References Cited

OTHER PUBLICATIONS

Gan et al.; "An Integrated Audio and Active Noise control Headsets"; IEEE Transactions on Consumer Electronics, vol. 48, No. 2, May 2002.
Sethia; "Noise Cancellation in Headphones"; M. Tech. credit seminar report, Electronic Systems Group, Nov. 2002.
Merched, et al.; "A New Delayless Subband Adaptive Filter Structure"; IEEE Transactions on Signal Processing, vol. 47, No. 6, Jun. 1999.

* cited by examiner

ADAPTIVE MODELING OF SECONDARY PATH IN AN ACTIVE NOISE CONTROL SYSTEM

TECHNICAL FIELD

This disclosure generally relates to active noise control in headsets.

BACKGROUND

Active noise control involves cancelling unwanted noise by generating a substantially opposite signal often referred to as anti-noise.

SUMMARY

In one aspect, this document features a computer implemented method that includes detecting, by one or more processing devices, onset of an unstable condition in an active noise control system. The method also includes obtaining, responsive to detecting the onset of the unstable condition, updated filter coefficients for a system-identification filter configured to represent a transfer function of a secondary path of the active noise control system. The updated filter coefficients are generated using a set of multiple subband adaptive filters, wherein filter coefficients of each subband adaptive filter in the set are configured to adapt to changes in a corresponding portion of a frequency range associated with potential unstable conditions in the active noise control system. The method also includes programming the system identification filter with the updated coefficients to affect operation of the active noise control system.

In another aspect, this document features an active noise control system that includes a system-identification filter configured to represent a transfer function of a secondary path of the active noise control system, and an active noise control engine. The active noise control engine includes one or more processors, and is configured to detect onset of an unstable condition in the active noise control system. Responsive to detection of the onset of the unstable condition, the active noise control engine obtains updated filter coefficients for the system-identification filter. The updated filter coefficients are generated using a set of multiple subband adaptive filters, wherein filter coefficients of each subband adaptive filter in the set are configured to adapt to changes in a corresponding portion of a frequency range associated with potential unstable conditions in the active noise control system. The active noise control engine is also configured to program the system identification filter with the updated coefficients to affect operation of the active noise control system.

In another aspect, this document features a machine-readable storage device having encoded thereon computer readable instructions for causing one or more processors to perform various operations. The operations include detecting onset of an unstable condition in an active noise control system. The operations also include obtaining, responsive to detecting the onset of the unstable condition, updated filter coefficients for a system-identification filter configured to represent a transfer function of a secondary path of the active noise control system. The updated filter coefficients are generated using a set of multiple subband adaptive filters, wherein filter coefficients of each subband adaptive filter in the set are configured to adapt to changes in a corresponding portion of a frequency range associated with potential unstable conditions in the active noise control system. The operations also include programming the system identification filter with the updated coefficients to affect operation of the active noise control system.

Implementations of the above aspects can include one or more of the following.

Detecting the onset of the unstable condition can include computing a correlation between signals from a secondary source and an error sensor of the active noise control system, and detecting the onset of the unstable condition upon determining that the correlation satisfies a threshold condition. Filter coefficients of each subband adaptive filter in the set can be obtained, and the updated filter coefficients for the system-identification filter can be generated as a combination of filter coefficients of multiple subband adaptive filters. The corresponding portions of the frequency range associated with two subband adaptive filters of the set can be at least partially non-overlapping. The filter coefficients for each subband filter in the set are updated based on a signal-to-noise ratio (SNR) in the portion of the frequency range associated with the corresponding subband filter. The active noise control system can be disposed in a headset. The active noise control system can be configured to cancel broadband noise. The secondary path can include an electro-acoustic path between an acoustic transducer and an error sensor associated with the active noise control system. Affecting the operation of the active noise control system can include reducing an effect of the unstable condition.

Various implementations described herein may provide one or more of the following advantages. By adaptively modeling the secondary path of an active noise control (ANC) system, any instability resulting from a change in the secondary path may be reduced, or in some cases, eliminated within a short time from the onset of such instability. Tracking the frequency or frequencies at which the instability is manifested, and using a corresponding subband filter for modeling the secondary path may in some cases allow for accurate and efficient modeling of the secondary path. By using the technology in ANC headsets or earphones, the headsets or earphones can be made compatible with accessories (e.g., different types of earbuds or tips) that may potentially alter the corresponding secondary paths. The technology may also be used in identifying events that alter the secondary paths of an ANC system. For example, when deployed in an ANC headset or earphone, the detected variations in the secondary path may be used in distinguishing one user from another, or in detecting when the headset or earphone is not being worn by a user.

Two or more of the features described in this disclosure, including those described in this summary section, may be combined to form implementations not specifically described herein.

The details of one or more implementations are set forth in the accompanying drawings and the description below. Other features, objects, and advantages will be apparent from the description and drawings, and from the claims.

DETAILED DESCRIPTION

This document describes techniques for adaptively modeling a secondary path of an active noise control (ANC) system. For example, the document describes techniques for detecting the onset of an unstable condition resulting from a change in the secondary path of the ANC system, and adaptively updating a model of the secondary path in order to address the unstable condition. This can be done, for example, by using an adaptive filter in a system identification mode. Such a filter is referred to herein as a system identification filter, and can include a bank of subband adaptive filters each of which corresponds to a different portion of the frequency band over which the unstable condition may be manifested. By detecting a frequency band associated with the unstable condition, the model of the secondary path may be updated by updating the coefficients of a corresponding subband filter. This way, in some cases, the unstable condition may be mitigated more accurately and efficiently than updating the model using one full-range adaptive filter.

Acoustic noise control systems are used for cancelling or reducing unwanted or unpleasant noise. For example, such noise control systems may be used in personal acoustic devices such as headsets and earphones to reduce the effect of ambient noise. Acoustic noise control can also be used in automotive or other transportation systems (e.g., in cars, trucks, buses, aircrafts, boats or other vehicles) to cancel or attenuate unwanted noise produced by, for example, mechanical vibrations or engine harmonics.

In some cases, Active Noise Control (ANC) systems can be used for attenuating or canceling unwanted noise. In some cases, an ANC system can include an electroacoustic or electromechanical system that can be configured to cancel at least some of the unwanted noise (often referred to as primary noise) based on the principle of superposition. This can be done by identifying an amplitude and phase of the primary noise and producing another signal (often referred to as an anti-noise) of about equal amplitude and opposite phase. An appropriate anti-noise signal combines with the primary noise such that both are substantially canceled (e.g., canceled to within a specification or acceptable tolerance). In this regard, in the example implementations described herein, "canceling" noise may include reducing the "canceled" noise to a specified level or to within an acceptable tolerance, and does not require complete cancellation of all noise. ANC systems can be used in attenuating a wide range of noise signals, including, for example, broadband noise and/or low-frequency noise that may not be easily attenuated using passive noise control systems. In some cases, ANC systems provide feasible noise control mechanisms in terms of size, weight, volume, and cost.

Figure 1:
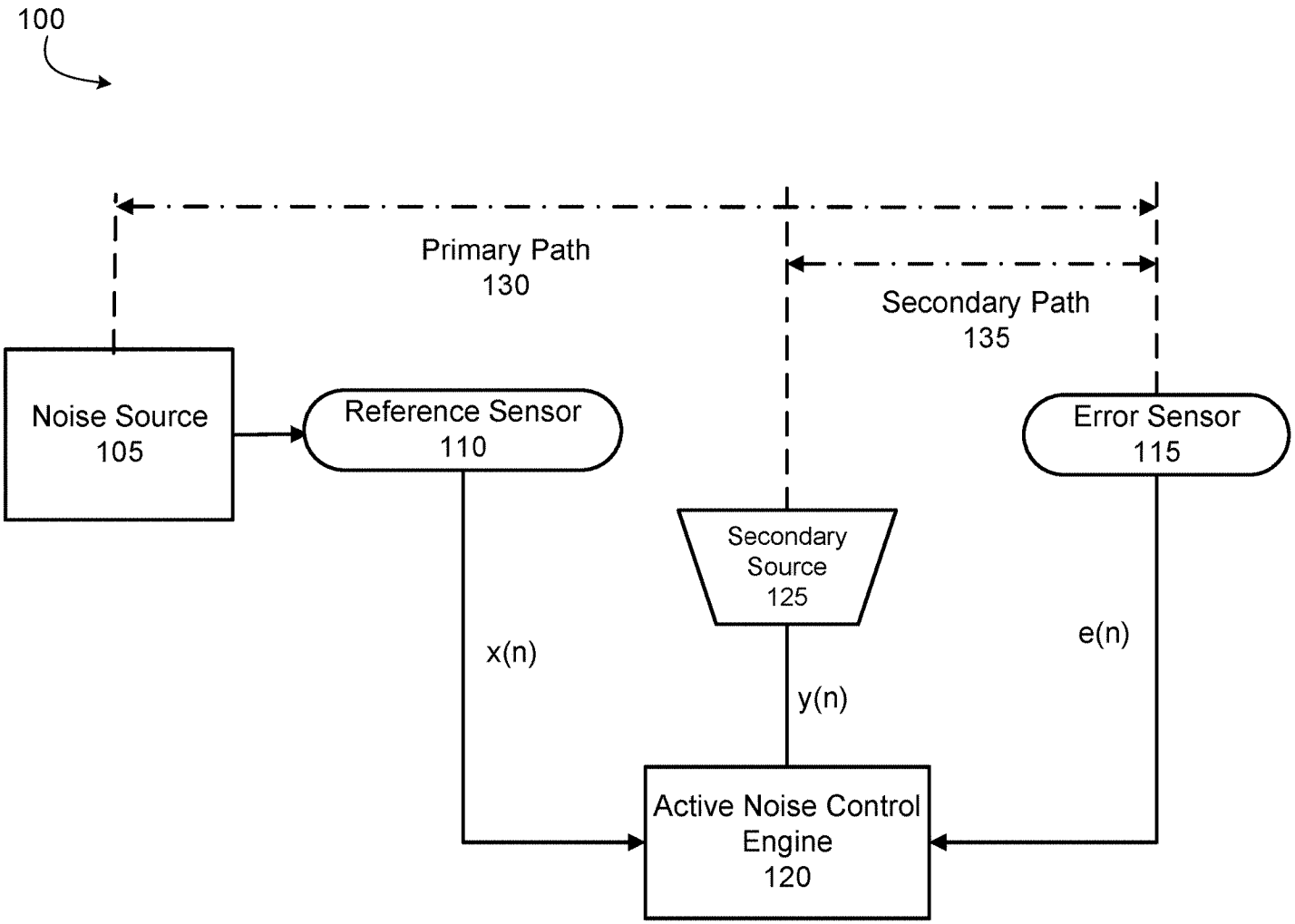
FIG. 1 is a block diagram of an example of an active noise control (ANC) system.

FIG. 1 shows an example of an active noise control system 100 for canceling a noise produced by a noise source 105. This noise can be referred to as the primary noise. For personal acoustic devices such as noise cancelling headphones or earphones, the primary noise may be ambient noise. For other systems, e.g., an ANC system deployed in an automobile, the primary noise can be a noise generated by the engine of the automobile. The nature of the primary noise may vary from one application to another. For example, for an ANC system deployed in a noise canceling headset or earphone, the primary noise can be broadband noise. In another example, for an ANC system deployed in an automobile, the primary noise can be a narrowband noise such as harmonic noise.

In some implementations, the system 100 includes a reference sensor 110 that detects the noise from the noise source 105 and provides a signal to an ANC engine 120 (e.g., as a digital signal x(n)). The ANC engine 120 produces an anti-noise signal (e.g., as a digital signal y(n)) that is provided to a secondary source 125. The secondary source 125 produces a signal that cancels or reduces the effect of the primary noise. For example, when the primary noise is an acoustic signal, the secondary source 125 can be configured to produce an acoustic anti-noise that cancels or reduces the effect of the acoustic primary noise. Any cancellation error can be detected by an error sensor 115. The error sensor 115 provides a signal (e.g., as a digital signal e(n)) to the ANC engine 120 such that the ANC engine can modify the anti-noise producing process accordingly to reduce or eliminate the error. For example, the ANC engine 120 can include an adaptive filter, the coefficients of which can be adaptively changed based on variations in the primary noise.

The ANC engine 120 can be configured to process the signals detected by the reference sensor 110 and the error sensor 115 to produce a signal that is provided to the secondary source 125. The ANC engine 120 can be of various types. In some implementations, the ANC engine 120 is based on feed-forward control, in which the primary noise is sensed by the reference sensor 110 before the noise reaches a secondary source such as secondary source 125. In some implementations, the ANC engine 120 can be based on feedback control, where the ANC engine 120 cancels the primary noise based on the residual noise detected by the error sensor 115 and without the benefit of a reference sensor 110. In some implementations, both feed-forward and feedback control are used. The ANC engine 120 can be configured to control noise in various frequency bands. In some implementations, the ANC engine 120 can be configured to control broadband noise such as white noise. In some implementations, the ANC engine 120 can be configured to control narrow band noise such as harmonic noise from a vehicle engine.

In some implementations, the ANC engine 120 includes an adaptive digital filter, the coefficients of which can be adjusted based on, for example, the variations in the primary noise. In some implementations, the ANC engine is a digital system, where signals from the reference and error sensors (e.g., electroacoustic or electromechanical transducers) are sampled and processed using processing devices such as digital signal processors (DSP), microcontrollers or microprocessors. Such processing devices can be used to implement adaptive signal processing techniques used by the ANC engine 120.

Figure 2:
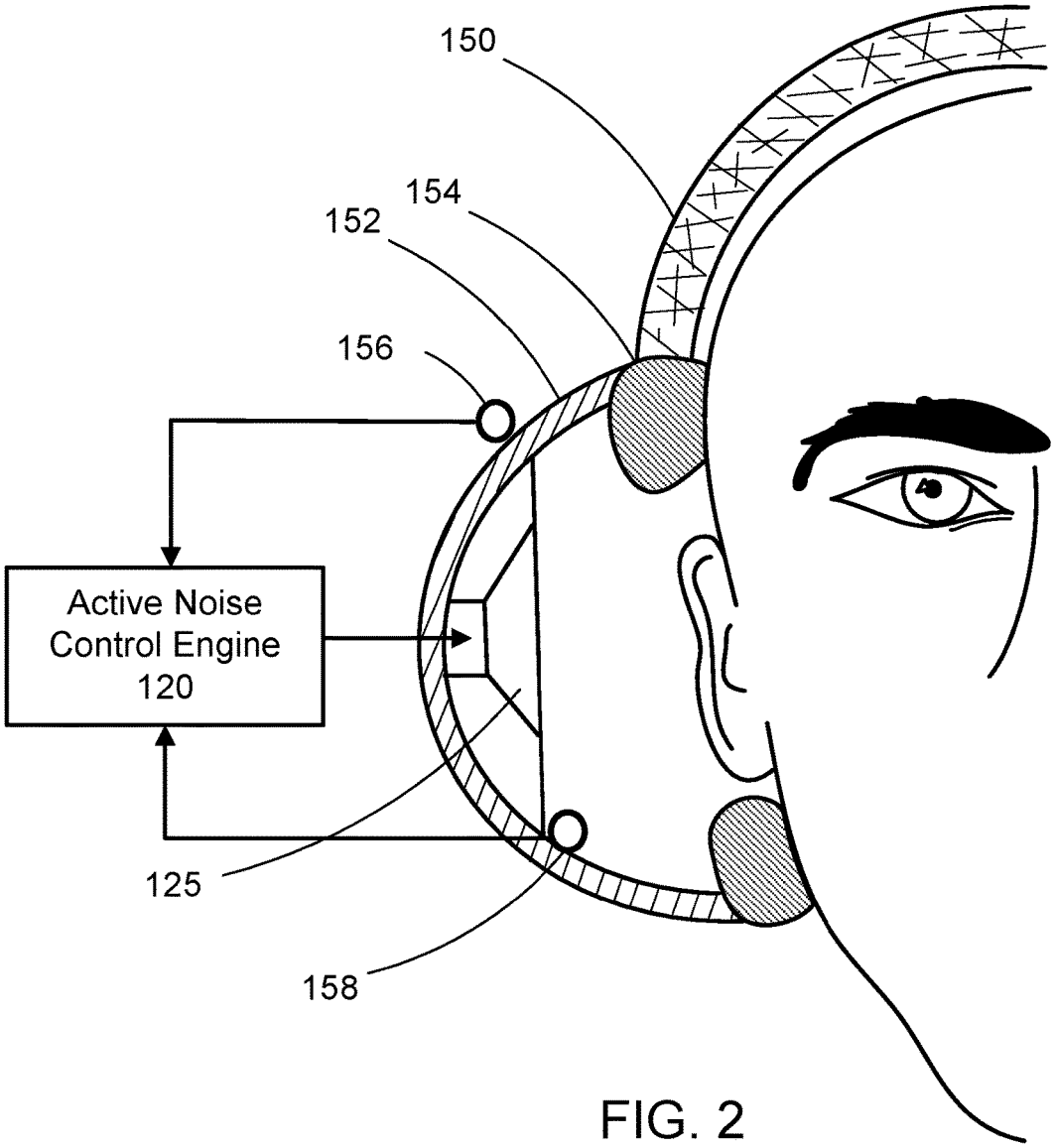
FIG. 2 shows an example of an ANC system deployed in a headset.

FIG. 2 shows an example of an ANC system deployed in a headset 150. The headset 150 includes an ear-cup 152 on each side, which fits on or over the ear of a user. The ear-cup 152 may include a layer 154 of soft material (e.g., soft foam) for a comfortable fit over the ear of the user. The ANC system on the headset 150 includes an external microphone 156 disposed on the outside of the ear-cup to detect ambient noise. The external microphone 156 may serve as the reference sensor (e.g., the reference sensor 110 shown in the block diagram of FIG. 1) for the ANC system. The ANC system also includes an internal microphone 158 which may serve as the error sensor (e.g., the error sensor 115 in the bock diagram of FIG. 1). The internal microphone 158 can be deployed proximate (e.g., within a few millimeters) to the user's ear canal and/or the secondary source 125. The secondary source 125 can be the acoustic transducer that radiates audio signals from an audio source device that the headset 150 is connected to. The external microphone 156, the internal microphone 158, and the secondary source 125 are connected to an active noise control engine 120 as shown in FIG. 2. While FIG. 2 shows the ANC engine 120 as a block external to the headset 150, the ANC engine 120 may be deployed in a portion of the headset 150 (e.g., in the ear-cup 152). In some implementations, the ANC engine 120 may also be deployed at a location external to the headset 150 (e.g., in a source device to which the headset 150 is connected). While FIG. 2 shows an ANC system deployed in a headset, such an ANC system may also be deployed in other personal acoustic devices such as earphones or hearing aids. Unless otherwise stated, any description with respect to headsets is applicable to such devices.

Referring again to FIG. 1, the acoustic path between the noise source and the error sensor 115 may be referred to as the primary path 130, and the acoustic path between the secondary source 125 and error sensor 115 may be referred to as the secondary path 135. In the example of FIG. 2, the acoustic path between the external microphone 156 and the internal microphone may form a portion of the primary path, and the acoustic path between the secondary source 125 and the internal microphone 158 may form the secondary path. In some implementations, the primary path 130 and/or the secondary path 135 can include additional components such as components of the ANC system or the environment in which the ANC system is deployed. For example, the secondary path can include one or more components of the ANC engine 120, secondary source 125, and/or the error sensor 115 (e.g., the internal microphone 158). In some implementations, the secondary path can include electronic components of the ANC engine 120 and/or the secondary source 125, such as one or more digital filters, amplifiers, digital to analog (D/A) converters, analog to digital (A/D) converters, and digital signal processors. In some implementations, the secondary path can also include an electro-acoustic response (e.g., frequency response and/or magnitude and phase response) associated with the secondary source 125, an acoustic path associated with the secondary source 125 and dynamics associated with the error sensor 115.

In some implementations, an ANC system may use a model of the secondary path (e.g., an acoustic transfer function representing the secondary path) in generating an anti-noise signal. Therefore, any changes to the model of the secondary path may affect the performance of the ANC system. For example, the secondary path of a headset 150 can change when the headset is moved from one user to another. The secondary path may also change if one or more portions of a headset or earphone is changed. For example, if the cushioning layer 154 is removed, or swapped with a different cushioning layer, the secondary path of the headset 150 may be altered. In implementations where the ANC system is deployed in an earphone that includes an ear-tip or earbud for positioning within the ear canal of a user, the secondary path can change with the removal or swapping of such ear-tip.

In some implementations, unless the model of the secondary path is updated to account for the variation in the secondary path, the corresponding ANC system may be rendered unstable. In some cases, instead of canceling noise, the ANC system may add more noise due to the instability. For a headset or earphone, this may be manifested, for example, by a screeching sound that degrades user-experience. In some cases, adverse effects due to a change in the secondary path may be mitigated by selecting a different model or transfer function for the secondary path from a set of preset models. However, in some cases, preset models for different changes may be unavailable, particularly if the nature of variation is not known in advance. For example, if an ANC earphone is to be made compatible with ear-tips manufactured by third-parties, preset models of the resulting secondary paths may not be available during the production of the ANC earphone. The technology described herein allows for updating the model of the secondary path using an adaptive filter. For example, one or more adaptive filters may be run in a system identification mode to update the model of the secondary path. In some cases, this may allow for accommodating a wide range of variations in the secondary path. Accommodating such a wide range may be challenging, or even impossible, for an ANC headset or earphone that uses a limited number of preset models for the secondary paths.

Figure 3:
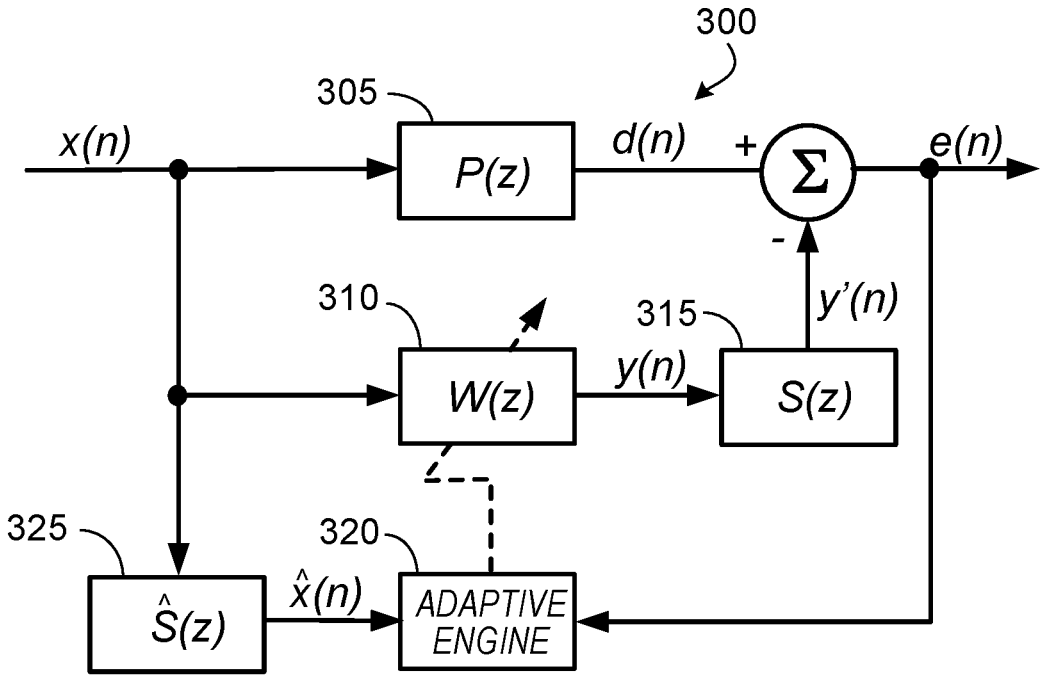
FIG. 3 is a block diagram of an example feedforward adaptive ANC system.
Figure 4:
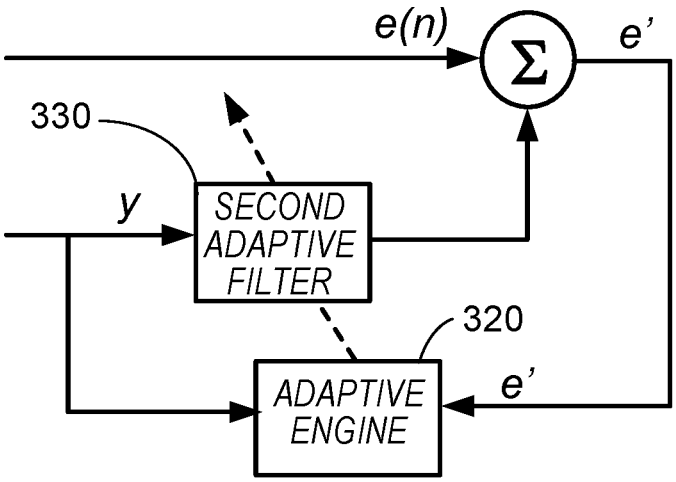
FIG. 4 is a block diagram of an example of an adaptive filter for modeling the secondary path of an ANC system.

FIGS. 3A and 3B are block diagrams showing implementation details of an example ANC system 300 in accordance with the technology described herein. Specifically, FIG. 3 is a block diagram of an example feedforward adaptive ANC system, and FIG. 4 is a block diagram of an example adaptive filter that can be used for modeling the secondary path in the ANC system of FIG. 3. Referring to FIG. 3, the ANC system 300 includes an adaptive filter that adapts to an unknown environment 305 represented by P(z) in the z domain. In this document, frequency domain functions may be represented in terms of their z domain representations, with the corresponding time domain (or sample domain) representations being functions of n. In this example, the transfer function of the secondary path 315 is represented as S(z). The adaptive filter 310 (represented as W(z)) can be configured to track time variations of the environment 305. In some implementations, the adaptive filter 310 can be configured to reduce (e.g., to substantially minimize) the residual error signal e(n). Therefore, the adaptive filter 310 is configured such that the target output y(n) of the adaptive filter 310, as processed by the secondary path, is substantially equal to the primary noise d(n). The output, when processed by the secondary path, can be represented as y'(n). The primary noise d(n), in this example is the source signal x(n) as processed by the unknown environment 305. Comparing FIG. 3 with the example of the ANC system deployed in the headset 150 (as shown in FIG. 2), the secondary path 315 can therefore include the secondary source 125 and/or the acoustic path between the secondary source 125 and the internal microphone 158. When d(n) and y(n) are combined, the residual error e(n) is substantially equal to zero for perfect cancellation, and non-zero for imperfect cancellation.

In some implementations, the ANC system 300 includes an adaptive engine 320. The adaptive engine 320 can be configured to compute and update the filter coefficients of the adaptive filter 310, for example, in accordance with changes in the primary noise. In some implementations, the adaptive engine 320 generates updated coefficients for the adaptive filter 310 based on output of a filter 325 configured to model the secondary path 315 of the active noise control system 300. The filter 325 is referred to herein as a system identification filter, the coefficients of which may represent, at least approximately, a transfer function of the secondary path 315. In some implementations, as shown in FIG. 4, the ANC system 300 can include a second adaptive filter 330 for updating the coefficients of the system identification filter 325 in accordance with variations in the secondary path 315. In some implementations, coefficients of the second adaptive filter 330 can be updated by the adaptive engine 320. In some implementations, a separate adaptive engine may be provided for updating the coefficients of the second adaptive filter 330.

In some implementations, the filter coefficients of the adaptive filter 310 and/or the second adaptive filter 330 can be updated based on an adaptive process implemented using the adaptive engine 320. The adaptive engine 320 can be implemented using a processing device such as a DSP, microcontroller, or microprocessor, and can be configured to update the coefficients of the adaptive filter 310 and/or the second adaptive filter 330 based on one or more input signals. In some implementations, the adaptive engine 320 can be configured to update the coefficients of the filter 310 based on the error signal e(n) and a version of the source signal, as processed by the system identification filter 325, which can be represented as:

$$\hat{x}(n)=\Sigma_{m=0}^{M-1}\hat{s}_m x(n-m)$$

where, $\hat{s}_m$ is the M-th order estimate of the secondary path impulse response, and $\hat{S}(z)$ is the corresponding z domain representation.

The adaptive engine 320 can be configured to update the adaptive filter coefficients in various ways. For example, the adaptive engine 320 can be configured to implement a least mean square (LMS) process (or a normalized least mean square (NLMS) process) to update the filter coefficients. For the filter 310, the vector of filter coefficient can be updated as:

$$w(n+1) = w(n) - \frac{\mu}{2}\nabla\xi(n)$$

Where μ represents a scalar quantity for step size, i.e., a variable controlling how much the coefficients are adjusted towards the destination in each iteration, $$\xi(n)\equiv E[e^2(n)]$$

is the mean squared error, and $$\hat{\xi}(n)=e^2(n)$$

$$\nabla\hat{\xi}(n)=2[\nabla e(n)]e(n)$$

Further, because $$e(n)=d(n)-w^T(n)x(n)$$

$$\nabla\hat{\xi}(n)=-2x(n)e(n)$$

the vector of filter coefficient can be updated as:

$$w(n+1)=w(n)+-\mu x(n)e(n)$$

In some implementations, the adaptive engine 320 can be configured to implement a filtered X-LMS (FxLMS) process that uses affine projection. In this process, the adaptive engine 320 can be configured to use past data to determine a future coefficient. In some implementations, using the FxLMS process, the vector of filter coefficients can be determined as:

$$w(n+1)=w(n)+-\mu X_{ap}(n)e_{ap}(n)$$

where $X_{ap}$ is a matrix that represents historical data related to the coefficient, with the number of columns being equal to the number of historical samples, and the number of rows being equal to the number of adaptive coefficients. $e_{ap}$ is a vector that represents corresponding historical error data. For example, for a two tap filter and five historical samples, $X_{ap}$ is a matrix with two rows and five columns, and $e_{ap}$ is a vector of five elements. In some implementations, the number of historical samples used by the adaptive engine 320 can be experimentally determined, or determined based on theoretical criteria. The processes described above can also be used for generating the coefficients of the second adaptive filter 330.

In some implementations, the coefficients of the system identification filter 325 are updated using the coefficients of the second adaptive filter 330 to account for dynamic changes in the secondary path 315. For example, the coefficients of the system identification filter 325 can be updated upon determination of an unstable condition in the ANC system 300. In some implementations, the coefficients of the system identification filter 325 may be updated intermittently, for example, at periodic intervals, possibly regardless of whether any unstable condition is detected. The second adaptive filter 330 can be updated independently to the updating of the system identification filter. For example, the second adaptive filter 330 may be updated substantially continuously, and the system identification filter 325 may be updated using the coefficients of the second adaptive filter 330, for example, upon detection of an unstable condition in the ANC system 300.

The system identification filter 325 can have multiple taps or coefficients. For example, a 128 tap filter can be used as the system identification filter to account for an entire frequency range over which potential unstable conditions may be manifested in the ANC system 300. However, in many practical applications, a given unstable condition in the ANC system 300 is manifested over a range of frequencies that is much smaller than the entire frequency range represented by all the taps of the system identification filter. For example, for an ANC system deployed in a headset or earphone, a particular unstable condition may be manifested as an audible sound over a small frequency range, which is a subset of the entire frequency range over which other unstable conditions in the headset or earphone may be manifested. In such cases, adapting the full range filter (e.g., all 128 taps in the present example) to account for changes over a much smaller frequency range may lead to inaccurate adaptation and/or even onset of other unstable conditions. For example, if the frequency range over which the unstable condition is manifested corresponds to only two or three taps of the system identification filter 325, adapting the full range (128 taps in the present example) may be inefficient and inaccurate. In some cases, such inaccurate adaptation of the taps or coefficients may also lead to other unstable conditions in the system. In some cases, the convergence of a high-order full range filter may also be slow, and therefore potentially unsuitable for adapting to fast changes.

In some implementations, the above noted problems may be mitigated by implementing the second adaptive filter 330 as a set of multiple subband adaptive filters. Each of the multiple subband adaptive filters can have a smaller number of coefficients, and represent a corresponding portion of the frequency range associated with potential unstable conditions in the active noise control system 300. In such cases, a given unstable condition in the ANC system 300 may trigger updates to the coefficients of only one or more subbands that are associated with the smaller frequency range of the given unstable condition. This way, in some cases, the subband filters corresponding to the substantially unaffected frequency bands do not try to adapt to the unstable condition, which in turn may lead to reduced chances of inaccurate adaptions across all the taps of the second adaptive filter 330. In some cases, fast convergence of such filters may make the filters suitable for adapting to fast changes.

Figure 5:
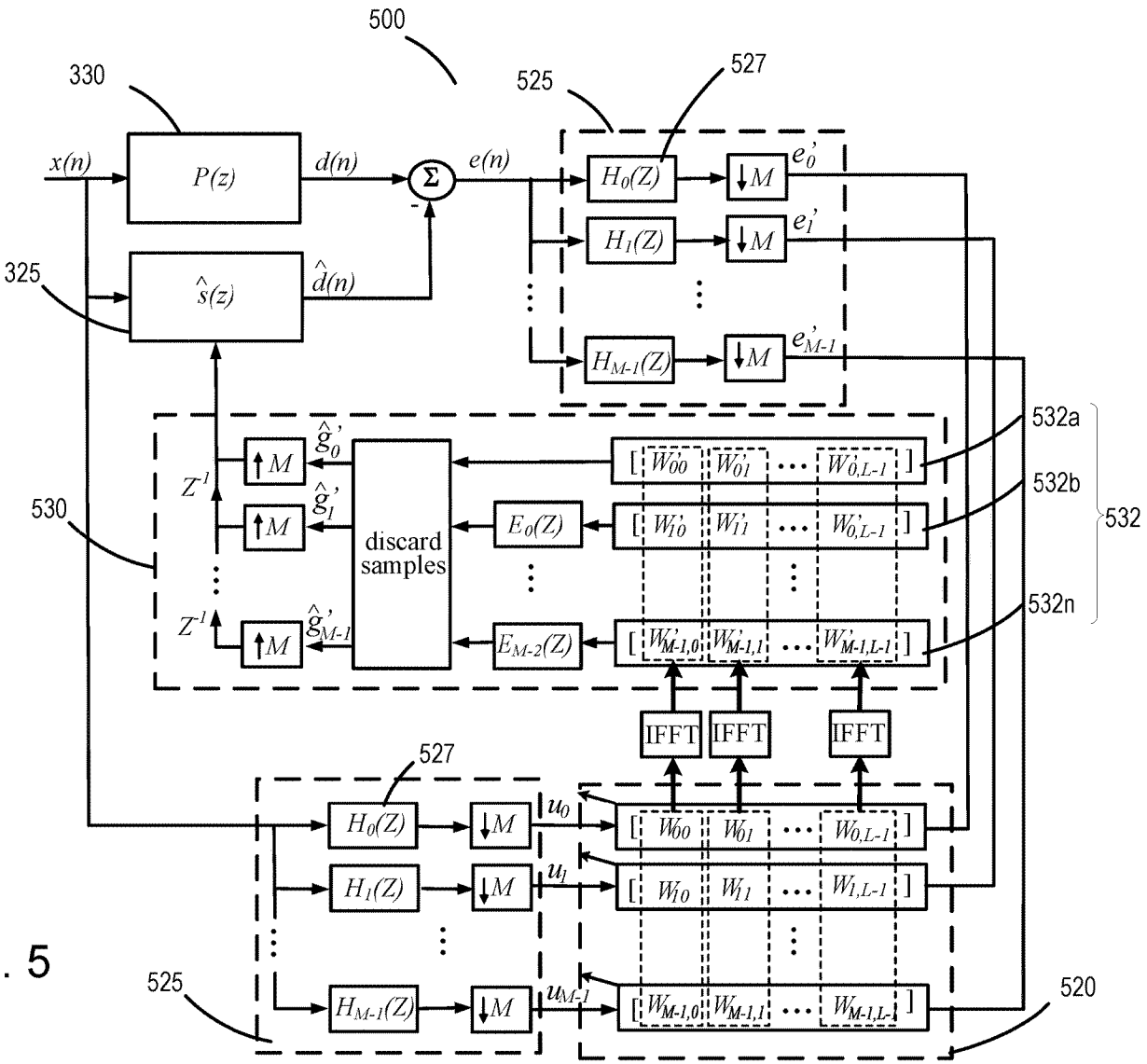
FIG. 5 is a block diagram of an ANC system where an adaptive filter includes a bank of subband filters.

FIG. 5 is a block diagram of an ANC system 500 where an adaptive filter 530 includes a bank of subband filters 532*a*-532*n* (532, in general). The filter coefficients of the filters 532 can be generated by the adaptive engine 520. The coefficients of the subband filters 532 can be combined to generate updated coefficients for the system identification filter 325. Each of the subband filters 532 can be configured to adapt to changes in a corresponding portion of the entire frequency range associated with potential unstable conditions in the active noise control system 500. In some implementations, frequency ranges associated with consecutive subband filters 532 (e.g., subband filters 532*a* and 532*b*) can be made partially overlapping.

In some implementations, a given subband filter 532 may be updated to account for an unstable condition in the corresponding frequency range. For this, the error signal e(n) may be passed through a filter bank 525 of bandpass filters 527 to split the error signal into multiple components. This process may be referred to a polyphase decomposition of the error signal. The passband of the individual bandpass filters 527 in the filter bank 525 are made at least partially non-overlapping such that the error signal is split into components that correspond to different frequency bands. In the example of FIG. 5, each component of the error signal is then provided to the adaptive engine 520 to generate coefficients for an adaptive filter associated with the corresponding portion of the frequency range.

The input signal x(n) (which is generated by the secondary source of the ANC system) is also decomposed using a filter bank 525 of bandpass filters 527. The input signal is therefore also split into multiple components corresponding to different frequency ranges, and provided to the adaptive engine 520 to generate coefficients for an adaptive filter associated with the corresponding portion of the frequency range. In some implementations, the individual components of the error signal and the input signal are downsampled, for example, to reduce processing burden for the adaptive engine 520.

In some implementations, the adaptive engine 520 can be configured to generate coefficients for individual subband adaptive filters 532 based on the corresponding components of the input signal x(n) and the error signal e(n). In some implementations, the adaptive engine 520 can be configured to compute a correlation between the corresponding components the input signal x(n) and the error signal e(n), and update the coefficients of the corresponding adaptive filter based on determining that the correlation satisfies a threshold condition. For example, if the correlation value satisfies the threshold, the adaptive engine 520 may determine that the coherence between the input and output in that particular frequency band is high, and update the filter coefficients accordingly to reduce such coherence. The updates can be performed in the frequency domain, which are then converted to filter coefficient values for subband filters 532, for example via a transformation operation such as an inverse Fast Fourier Transform (IFFT). In some implementations, the filter coefficient values of the different subband filters 532 can be combined (e.g., via an overlap-add or overlap-save process) and provided to the system identification filter 325. For example, the coefficients of the subband filters can be combined and copied as the filter coefficients for the system identification filter 325 upon detection of an unstable condition in the ANC system 500.

FIG. 5 illustrates one particular example of filter structures that may be used for the technology described herein. Other structures that use subband filters may also be used. Additional examples of such filter structures are described in the publication: Merched et. al, "*A New Delayless Subband Adaptive Filter Structure*," IEEE Transactions on Signal Processing, Vol. 47, No. 6, June 1999, the entire content of which is incorporated herein by reference.

In some implementations, tracking accuracy of the subband filters 532 may be improved by providing additional spectral information that is processed by the adaptive engine 520 to generate the corresponding filter coefficients. This may be useful, for example, when the corresponding component of the error signal occupies a relatively small portion of the frequency range associated with the subband filter. In such cases, accuracy and/or convergence of the corresponding adaptive subband filter may be improved by artificially supplying additional spectral content/information for the frequency range associated with the subband filter. In some implementations, such information can be provided by adding shaped white noise to the output of the secondary source of the ANC system upon detection an unstable condition. The shaping of the white noise may depend, for example, on the nature of manifestation of the unstable condition. In some cases, such additional spectral content may serve to broaden the frequency range over which the system identification is performed by a subband filter. Spectral content may also be added in generating updated coefficients for a full-range adaptive filter that does not include subband filters.

In some implementations, acoustic output from a transducer (e.g., the acoustic transducer 125 disposed in the headset illustrated in FIG. 2) may also be used for system identification. For example, the acoustic output may be used in updating the coefficients of subband filters (or a full-range adaptive filter), which in turn are used for updating the coefficients of a system identification filter. While content (e.g., music) played through the acoustic transducer may sometimes be spectrally sparse, such content may sometimes be adequate for quickly generating at least an approximate estimate of the secondary path, and adjusting the system identification filter accordingly to improve performance of the ANC system.

Figure 6:
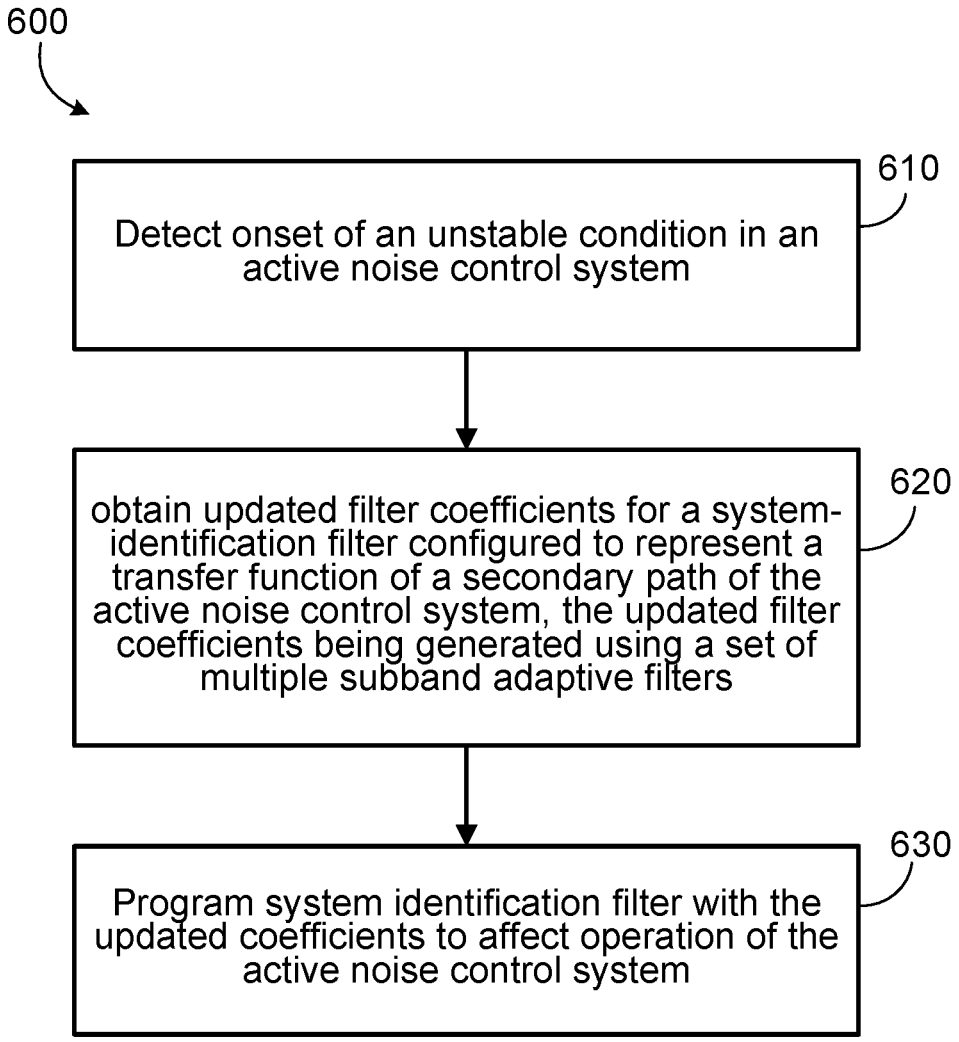
FIG. 6 is a flowchart of an example process for programming a system identification filter that represents a model of a secondary path in an ANC system.

FIG. 6 shows a flowchart for an example process 600 for updating coefficients of a system identification filter to account for changes to the secondary path of an ANC system. In some implementations, at least a portion of the process is executed at an adaptive engine (e.g., the ANC engine 120 or the adaptive engines 320 or 520, as described above). Example operations of the process 600 include detecting an onset of an unstable condition in an ANC system (610). As an ANC system begins to go unstable, the signal at the error sensor (e.g., the internal microphone 158 in FIG. 2) may become dominated by the output of the secondary source of the ANC system. In such cases, detecting the onset of the unstable condition can include computing a correlation between signals from a secondary source and an error sensor of the active noise control system, and detecting the onset of the unstable condition upon determining that the correlation satisfies a threshold condition. This is illustrated in FIG. 7A, which illustrates plots associated with an ANC system attempting to cancel a background noise represented by the plot 705.

Figure 7A:
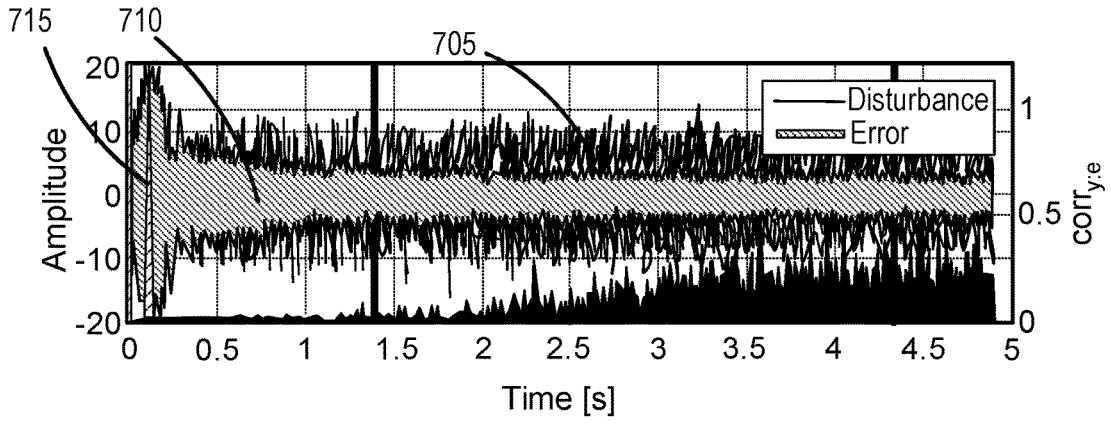
FIGS. 7A-7C are plots illustrating results of using a system identification filter in an ANC system in accordance with technology described herein.

Specifically, FIG. 7A shows the results of 5 second simulation of a broadband, feed-forward FxLMS adaptive filter. The plot 710 represents the signal received by the error sensor, and the plot 715 represents a correlation between the output of the secondary sensor and the signal received by the error sensor. In the example, the correlation plot 715 exhibits a peak around 0.2 s. At this point, the signal received by the error sensor became highly correlated with the output of the secondary source, which indicated the onset of an unstable condition in the system. The system identification filter was reprogrammed upon detection of the unstable condition.

Referring again to FIG. 6, the process 600 also includes obtaining updated filter coefficients for a system-identification filter configured to represent a transfer function of a secondary path of the active noise control system (620). This can be done, for example, responsive to detection of the onset of the unstable condition. In some implementations, the updated filter coefficients can be generated using a set of multiple subband adaptive filters, wherein filter coefficients of each subband adaptive filter in the set are configured to adapt to changes in a corresponding portion of a frequency range associated with potential unstable conditions in the active noise control system. In some implementations, this can include obtaining the filter coefficients of each subband adaptive filter in the set, and generating the updated filter coefficients for the system-identification filter as a combination of filter coefficients of multiple subband adaptive filters. In some implementations, the corresponding portions of the frequency range associated with two subband adaptive filters of the set are at least partially non-overlapping. In some implementations, the filter coefficients for each subband filter in the set are updated based on a signal-to-noise ratio (SNR) in the portion of the frequency range associated with the corresponding subband filter. For example, considering the output of the secondary source as the signal, a high SNR may signify a run-away condition and therefore a potentially unstable condition. In some implementations, the coefficients of a subband filter are updated only if the SNR in the corresponding frequency range exceeds a threshold value. The threshold value may be determined experimentally.

Figure 7B:
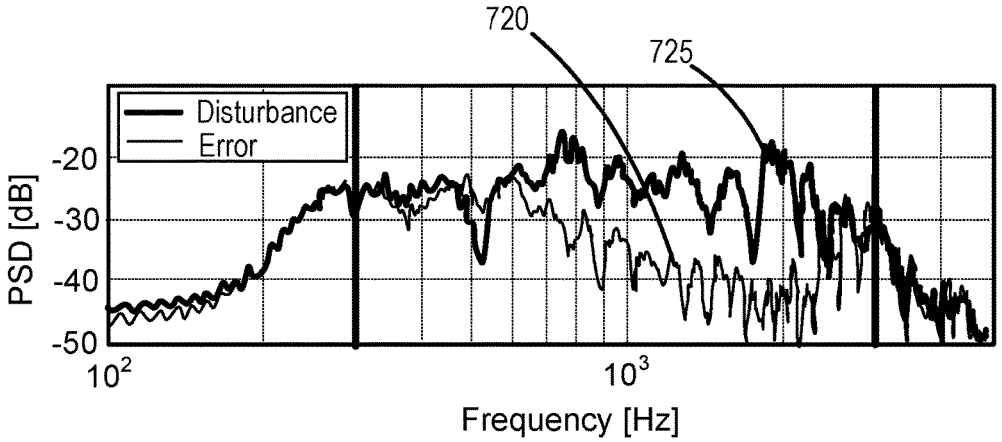
Figure 7C:
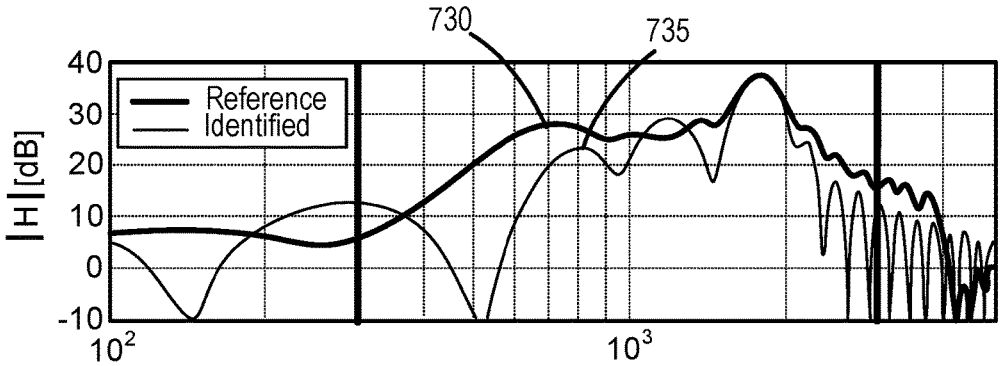

Operations of the process 600 also includes programming the system identification filter with the updated coefficients to affect operation of the active noise control system (630). Affecting the operation of the active noise control system can include reducing an effect of the unstable condition. This is illustrated via the plots shown in FIGS. 7A and 7B. In the example of FIG. 7A, upon detection of the unstable condition, the system identification filter was reprogrammed with coefficients obtained from the subband filters. This resulted in a reduction of the error (as indicated by the time variance of the plot 710), as well as a reduction in the correlation between the output of the secondary sensor and the signal received by the error sensor (as indicated by the time variance of the plot 715). Further, FIG. 7B illustrates the reduction in the power spectral density (PSD) of the error signal 720 in comparison to the PSD of the noise signal 725 upon reprogramming of the system identification filter. FIG. 7C shows how the transfer function of the secondary path is tracked by that of the system identification filter. In the example of FIG. 7C, the plot 730 illustrates the magnitude response of a reference secondary path, while the plot 735 illustrates the magnitude response of the system identification filter implemented in accordance with the technology described herein. As evident from FIG. 7C, the magnitude response of the system identification filter was found to closely track the magnitude response of the reference secondary path.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Other embodiments and applications not specifically described herein are also within the scope of the following claims. For example, the technology described herein may be used to generate a customized set of coefficients for individual users, thereby allowing for increased personalization of ANC headsets. Further, because an abnormal or distorted transfer function of the secondary path may be indicative of a damaged product (or a particular abnormal condition), the generated coefficients for the system identification filter may be used, for example, in hardware diagnostics, and/or to mitigate abnormal or undesirable conditions. Elements of different implementations described herein may be combined to form other embodiments not specifically set forth above. Elements may be left out of the structures described herein without adversely affecting their operation. Furthermore, various separate elements may be combined into one or more individual elements to perform the functions described herein.

What is claimed is:

1. A computer-implemented method comprising:

detecting, by one or more processing devices, onset of an unstable condition in an active noise control system;

responsive to detecting the onset of the unstable condition, obtaining updated filter coefficients for a system-identification filter configured to represent a transfer function of a secondary path of the active noise control system, the updated filter coefficients being generated using a set of multiple subband adaptive filters, wherein filter coefficients of each subband adaptive filter in the set are configured to adapt to changes in a corresponding portion of a frequency range associated with potential unstable conditions in the active noise control system; and programming the system identification filter with the updated coefficients to affect operation of the active noise control system.

2. The method of claim 1, wherein detecting the onset of the unstable condition comprises:

computing, by the one or more processing devices, a correlation between signals from a secondary source and an error sensor of the active noise control system; and detecting the onset of the unstable condition upon determining that the correlation satisfies a threshold condition.

3. The method of claim 1, further comprising:

obtaining the filter coefficients of each subband adaptive filter in the set; and generating the updated filter coefficients for the system-identification filter as a combination of filter coefficients of multiple subband adaptive filters.

4. The method of claim 1, wherein the corresponding portions of the frequency range associated with two subband adaptive filters of the set are at least partially non-overlapping.

5. The method of claim 1, wherein filter coefficients for each subband filter in the set are updated based on a signal-to-noise ratio (SNR) in the portion of the frequency range associated with the corresponding subband filter.

6. The method of claim 1, wherein the active noise control system is disposed in a headset.

7. The method of claim 1, wherein the active noise control system is configured to cancel broadband noise.

8. The method of claim 1, wherein the secondary path comprises an electro-acoustic path between an acoustic transducer and an error sensor associated with the active noise control system.

9. The method of claim 1, wherein affecting the operation of the active noise control system comprises reducing an effect of the unstable condition.

10. An active noise control system comprising:

a system-identification filter configured to represent a transfer function of a secondary path of the active noise control system; and an active noise control engine including one or more processors configured to:

detect onset of an unstable condition in the active noise control system;

responsive to detection of the onset of the unstable condition, obtain updated filter coefficients for the system-identification filter, the updated filter coefficients being generated using a set of multiple subband adaptive filters, wherein filter coefficients of each subband adaptive filter in the set are configured to adapt to changes in a corresponding portion of a frequency range associated with potential unstable conditions in the active noise control system; and program the system identification filter with the updated coefficients to affect operation of the active noise control system.

11. The active noise control system of claim 10, wherein detecting the onset of the unstable condition comprises:

computing a correlation between signals from a secondary source and an error sensor of the active noise control system; and detecting the onset of the unstable condition upon determining that the correlation satisfies a threshold condition.

12. The active noise control system of claim 10, wherein the active noise control engine is further configured to:

obtain the filter coefficients of each subband adaptive filter in the set; and generate the updated filter coefficients for the system-identification filter as a combination of filter coefficients of multiple subband adaptive filters.

13. The active noise control system of claim 10, wherein the corresponding portions of the frequency range associated with two subband adaptive filters of the set are at least partially non-overlapping.

14. The active noise control system of claim 10, wherein filter coefficients for each subband filter in the set are updated based on a signal-to-noise ratio (SNR) in the portion of the frequency range associated with the corresponding subband filter.

15. The active noise control system of claim 10, wherein the active noise control system is disposed in a headset.

16. The active noise control system of claim 10, wherein the active noise control system is configured to cancel broadband noise.

17. The active noise control system of claim 10, wherein the secondary path comprises an electro-acoustic path between an acoustic transducer and an error sensor associated with the active noise control system.

18. The active noise control system of claim 10, wherein affecting the operation of the active noise control system comprises reducing an effect of the unstable condition.

19. A machine-readable storage device having encoded thereon computer readable instructions for causing one or more processors to perform operations comprising:

detecting onset of an unstable condition in an active noise control system;

responsive to detection of the onset of the unstable condition, obtaining updated filter coefficients for a system-identification filter configured to represent a transfer function of a secondary path of the active noise control system, the updated filter coefficients being generated using a set of multiple subband adaptive filters, wherein filter coefficients of each subband adaptive filter in the set are configured to adapt to changes in a corresponding portion of a frequency range associated with potential unstable conditions in the active noise control system; and programming the system identification filter with the updated coefficients to affect operation of the active noise control system.

20. The machine-readable storage device of claim 19, wherein detecting the onset of the unstable condition comprises:

computing a correlation between signals from a secondary source and an error sensor of the active noise control system; and detecting the onset of the unstable condition upon determining that the correlation satisfies a threshold condition.

* * * * *